United States Patent [19]

Abadie et al.

[11] 4,321,871

[45] Mar. 30, 1982

[54] TARGET DETECTING DEVICE

[75] Inventors: Erwin I. Abadie, Houston, Tex.; John O. Dick, Riverside; Howard M. Forrester, Corona, both of Calif.

[73] Assignee: The United States of America as represented by the Secretary of the Navy, Washington, D.C.

[21] Appl. No.: 725,262

[22] Filed: Apr. 24, 1968

[51] Int. Cl.[3] ..... F42C 13/04

[52] U.S. Cl. ..... 102/214

[58] Field of Search ..... 102/70.2; 244/3.14, 244/3.19; 343/14

[56] References Cited

U.S. PATENT DOCUMENTS 3,081,050 3/1963 Lapham, Jr. et al. ..... 244/3.19

3,362,657 1/1968 McDaniel ..... 244/3.19

*Primary Examiner*—Charles T. Jordan

*Attorney, Agent, or Firm*—Robert F. Beers; J. M. St. Amand; T. M. Phillips

[57] ABSTRACT

A passive target detecting system for discriminating against both doppler and continuous wave off-target radars. A signal from the missile guidance system representing the pulse repetition frequency of the target being tracked is combined in a coincidence circuit with the signals received by the target detecting device. Doppler signals are compared directly while CW signals are processed through a chopper amplifier circuit to simulate doppler signals before comparison.

3 Claims, 2 Drawing Figures

TARGET DETECTING DEVICE

The invention herein described may be manufactured and used by or for the Government of the United States of America for governmental purposes without the payment of any royalties thereon or therefor.

BACKGROUND OF THE INVENTION

The present invention relates to passive target detecting systems and more particularly to target detecting systems with the capability of discriminating against both doppler and continuous wave off-target radars. The present invention is an improvement over the target detecting system disclosed and described in copending application of Erwin I. Abadie et al., Ser. No. 553,344 filed May 24, 1966 for Target Detecting Device. In the above referenced application a system is disclosed which will provide a firing signal at the proper point in the missile trajectory. The circuitry for processing a signal received from an enemy radar target works in conjunction with a phased antenna providing a negative output signal when the target is in a position forward of the critical or cross-over angle and a positive signal output when the target has passed the cross-over angle. If the signal from the antenna is positive, a firing signal is generated thereby initiating firing of the missile warhead. The above described system does not provide for CW radar.

SUMMARY

The present invention provides an improved target detecting device which can discriminate aginst both pulsed and CW off-target radars. The improvement embraces the provision of a means for chopping the antenna output signal which has a DC component representing the average value of the CW signal. A pulsed signal is then provided which may be processed by the same circuitry used for processing the pulsed radar target signals.

Many of the attendant advantages of this invention will become readily appreciated as the same becomes better understood by reference to the following detailed description when considered in connection with the accompanying drawings wherein.

Figure 1:
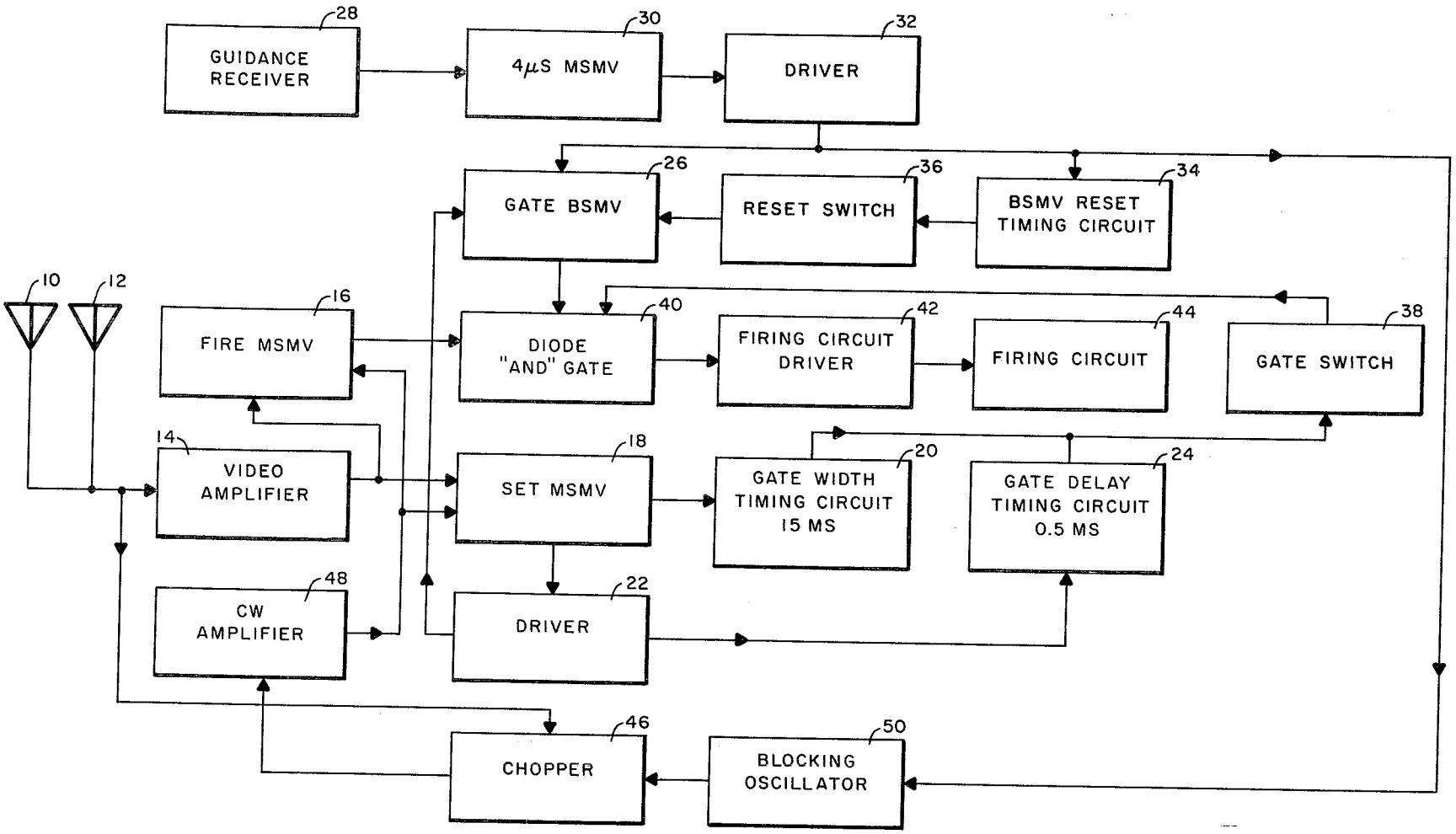
FIG. 1 is a block diagram of a preferred embodiment of the invention.

Referring to FIG. 1 there is shown antenna 10, 12 for receiving signals from radiating targets which by way of example may be early-warning radars. The signals received at antennas 10, 12 are fed to amplifier 14 where the signals are amplified and fed to fire monostable multivibrator 16 and set monostable multivibrator 18 which produces a first output that is fed to gate width timing circuit 20 and a second output that is fed to driver circuit 22. Driver circuit 22 provides a first output which is fed to gate delay timing circuit 24 and a second output that is fed to gate bistable multivibrator 26. A signal proportional to the pulse repetition frequency of the target is fed from guidance receiver 28 to a four microsecond monostable multivibrator 30. The output from monostable multivibrator 30 is coupled through driver circuit 32 to gate bistable multivibrator 26 and bistable multivibrator reset timing circuit 34. The timing pulse from circuit 34 is fed to reset switch 36 which provides a fail-safe signal to gate 26.

The outputs from gate width timing circuit 20 and gate delay timing circuit 24 are fed to gate switch 38 which provides one of the control signals for "and" gate 40. The other control signals for "and" gate 40 are supplied by fire monostable multivibrator 16 and gate bistable multivibrator 26. The output of "and" gate 40 is fed through a driver circuit 42 to provide a firing pulse for firing circuit 44. The signals received at antenna 10, 12 are also fed to chopper circuit 46 which provides a pulsed output that is fed to CW amplifier 48 which provides a second input for each of fire monostable multivibrator 16 and set monostable multivibrator 18. In order to synchronize the DC processing chopper amplifier so that coincidence will exist between the missile guidance computer (not shown) and the detecting device when the missile is in a CW environment, blocking oscillator 50 triggered by the output signal of driver 32 determines the chopping frequency of chopper 46.

Figure 2:
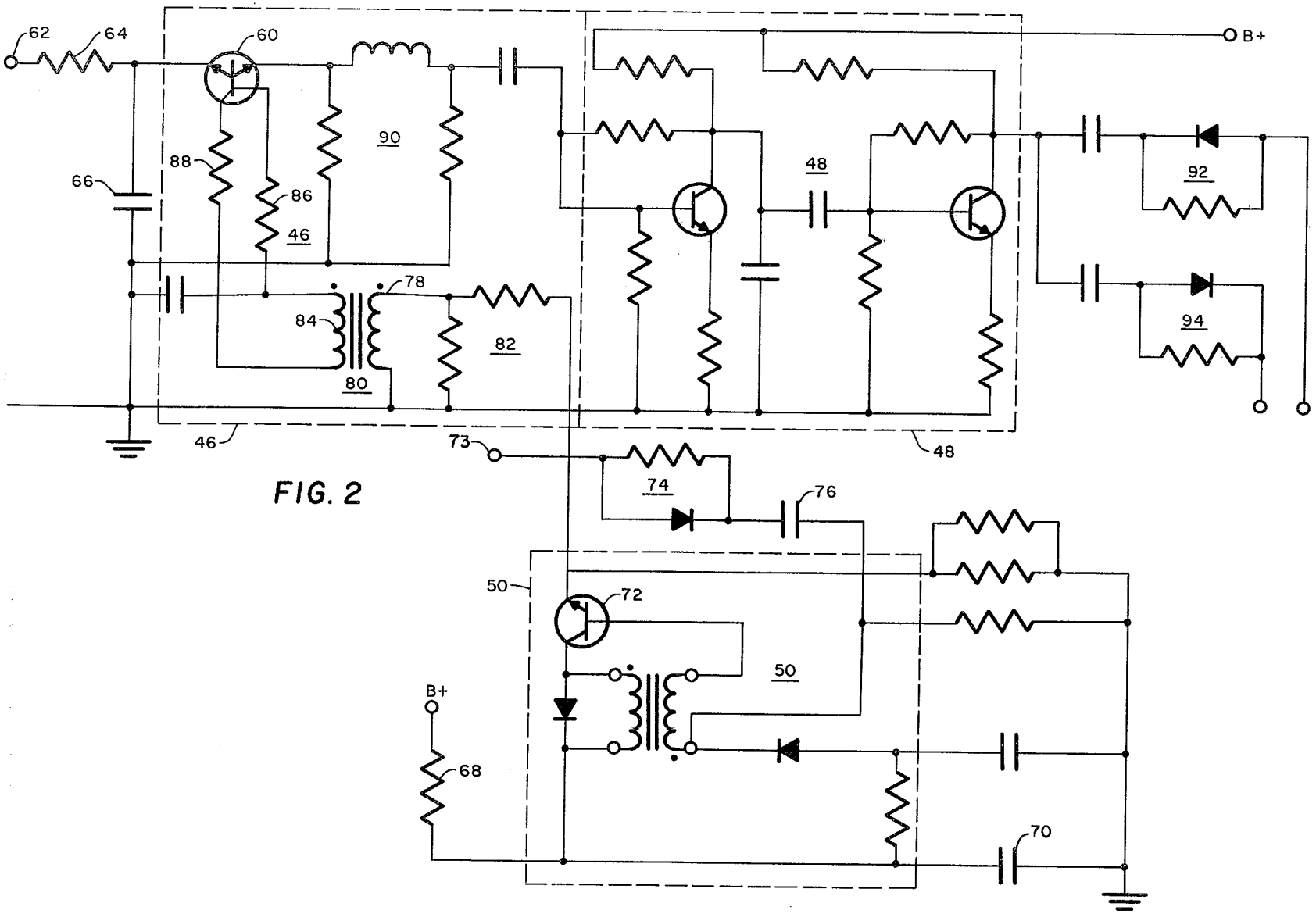
FIG. 2 is a schematic diagram of the CW to pulse signal conversion portion of the embodiment of FIG. 1.

Referring to FIG. 2, the signals received at antenna 10, 12 are fed to dual emitter chopper transistor 60 through terminal 62 and low pass filter composed of resistor 64 and capacitor 66. Blocking oscillator 50 is shown in standard configuration and will not be described in detail. A decoupling filter comprised of resistor 68 and capacitor 70 is connected between the collector of transistor 72 and B+ to prevent ripple from appearing on B+ supply. The synchronized pulse received at terminal 73 from the guidance monostable multivibrator 30 is coupled through steering circuit 74 and coupling capacitor 76 to blocking oscillator 50. Steering circuit 74 ensures synchronization with the leading edge of the output pulse from guidance monostable multivibrator 30.

Pulse signals out of blocking oscillator 50 are coupled to the primary winding 78 of driver transformer 80 through resistor divider network 82. The secondary winding 84 of driver transformer 80 provides pulses of opposite polarity through resistors 86 and 88 which are required to make chopper transistor 60 conduct only for the duration of the pulses. During the conduction period, the signal (positive or negative) appearing at terminal 62 is passed by chopper transistor 60 to low pass filter 90 and chopper amplifier 48 where they are amplified as pulses of the same width as drive pulses supplied by drive transformer 80. Coupling to set monostable multivibrator 18 is provided through steering circuit 92 so that only negative polarity pulses will be passed. Coupling to fire monostable multivibrator 16 is through steering circuit 94 so only positive polarity pulses will be passed.

In operation, the signal received from antennas 10 and 11 is of negative polarity before the antenna cross-over angle is reached and is either a series of negative video pulses (if the target radar is pulsed) or a negative dc signal with an ac component identified by the type of modulation used by the CW target radar. If the target radar signal is CW, the antenna output has a dc component representing the average value of the CW signal. This dc signal is processed through chopper 46 and amplifier 48 and provides a pulse type signal. If the received signal is video pulsed then it is fed to amplifier 14. The outputs of amplifiers 14 and 48, representing the pulsed radar signals and the chopped dc signal are paralleled and fed to fire monstable multivibrator 16 and set monostable multivibrator 18. If the output signal from antennas 10 and 12 is negative, it is fed to set monostable multivibrator 18 which controls the two timing circuits 20 and 24 that control gate switch 38 which in turn controls one input to diode and gate 40. Initially, the sum of the output voltages of timing circuits 20 and 24 is such that there is no signal at the output of gate switch 38. When set monostable multivibrator 18 is triggered, timing circuits 20 and 24 are switched and the output of gate switch 38 is still at a low potential. After a time delay (0.5 ms for example) a negative pulse from set monostable multivibrator 18, timing circuit 24 flips back to its initial state and the output of gate switch 38 will be at a high potential. This voltage is applied as one input to and gate 40 and should remain for a predetermined time interval, for example, 15 ms or until another negative pulse occurs.

The signal received from guidance receiver 28 represents the pulse repetition frequency of the target signal on which the missile is guiding. Initially, the output of gate bistable multivibrator 26 is at a low potential or conducting. When the leading edge of the output pulse of monostable multivibrator 30 arrives, gate bistable multivibrator is turned off causing it to have a high potential output until it is turned on by the trailing edge of the same pulse. Each time gate 26 is turned off, a signal is applied, as the second input to and gate 40. When no signal is received from the guidance receiver 28, gate bistable multivibrator is turned off by reset timing circuit 34, thus applying a continuous signal to gate 26. If a positive signal is received, fire monostable multivibrator is triggered and its output is applied as the third input to diode and gate 40. When all three signals are in coincidence, an output signal is generated and fed to firing circuit 44.

The signal from the guidance receiver 28 is used to synchronize chopper 46 and amplifier 48 when the missile is in a CW environment. The signal from guidance receiver 38 in a CW environment is normally at a pulse repetition rate of 5000 pulses per second. As a result, gate delay circuit 24 holds the gate to firing circuit 44 closed as long as negative dc signals are present at the output of antennas 10, 12, because this repetition rate exceeds the 0.5 ms gate delay interval. This prevents any ac component which might be coupled into amplifier 14 and causing premature firing. Should the guidance signal fail or not be present, chopper drive oscillator 50 free-runs at 3000 pulses per second and coincidence is not necessary. This repetition rate also allows gate delay circuit 24 to hold the gate to firing circuit 44 closed, because the 3000 pulses per second rate exceeds the normal 0.5 ms gate delay interval.

We claim:

1. In a target detecting device of the passive type for use in a guided missile:

(a) signal receiving means for receiving pulsed and continuous wave signals from radiating targets for producing negative and positive output pulses and positive and negative dc signals, (b) missile guidance circuit means for receiving signals from radiating targets and producing output signals representing the pulse repetition rate of the target radar of interest, (c) an "and" gate circuit having a plurality of inputs and an output, (d) chopper-amplifier circuit means coupled to said signal receiving means and to said missile guidance circuit means for producing an output pulse signal having the same pulse repetition rate as the signal received by said missile guidance circuit means, (e) first gate signal generating means having a first input coupled to said signal receiving means, a second input coupled to said chopper-amplifier circuit means and having an output coupled to one of the inputs of said "and" gate for generating a first gate signal in response to received negative pulses at either of said first and second inputs, (f) second gate signal generating means having a first input coupled to said signal receiving means, a second input coupled to said chopper-amplifier circuit means and having an output coupled to one of the inputs of said "and" gate for generating a second gate signal in response to received negative pulses at either of said first and second inputs, (g) third gate signal generating means coupled to said missile guidance circuit and to one of the inputs of said "and" gate for generating a gate signal in response to the guidance signal representing the pulse repetition rate of the target radar of interest, (h) firing circuit means coupled to the output of said "and" gate and being responsive to an output signal from said "and" gate when all three gate signals are simultaneously present to initiate a firing signal.

2. The target detecting device of claim 1 wherein synchronizing means are coupled between said chopper-amplifier circuit means and said missile guidance circuit for causing said chopper to produce pulses of the same repetition rate as the target signal of interest.

3. The target detecting device of claim 2 wherein said synchronizing means is a free running blocking oscillator operating at a predetermined frequency.

* * * * *